US007976014B2

(12) United States Patent
Kobayashi

(10) Patent No.: US 7,976,014 B2
(45) Date of Patent: Jul. 12, 2011

(54) FEEDING DEVICE AND RECORDING DEVICE WITH DOWNSTREAM SEPARATING MEMBER FROM DELIVERING MEMBER

(75) Inventor: Satoshi Kobayashi, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 88 days.

(21) Appl. No.: 12/511,916

(22) Filed: Jul. 29, 2009

(65) Prior Publication Data

US 2010/0025913 A1 Feb. 4, 2010

(30) Foreign Application Priority Data

Jul. 30, 2008 (JP) ..... 2008-196778

(51) Int. Cl.
*B65H 3/52* (2006.01)

(52) U.S. Cl. ..... 271/121; 271/119

(58) Field of Classification Search ..... 271/109, 271/119, 120, 121, 167
See application file for complete search history.

(56) References Cited

U.S. PATENT DOCUMENTS 5,775,688 A * 7/1998 Kato et al. ..... 271/167
6,305,682 B1 * 10/2001 Saito et al. ..... 271/167
2008/0315497 A1 12/2008 Kobayashi

FOREIGN PATENT DOCUMENTS

JP 02178133 A * 7/1990
JP 08-091612 4/1996
JP 2009-001366 1/2009

* cited by examiner

*Primary Examiner* — Gerald W McClain
(74) *Attorney, Agent, or Firm* — Workman Nydegger

(57) ABSTRACT

A feeding device includes a mounting portion capable of having mounting a plurality of recording media mounted in a stacked state thereon, a delivering member which performs a feeding operation in a state in which its contact surface is in contact with a top recording medium of the recording media mounted on the mounting portion to perform delivery of the recording media by using the frictional force generated between the delivering member and the top recording medium as the transporting force, a separating member having an inclined surface against which the leading end of the recording medium delivered by the delivering member can hit up against, the separating member being fixed in place at a downstream side of the mounding portion in a feeding direction of the recording media, a gate member, and a gate urging member.

6 Claims, 4 Drawing Sheets

FEEDING DEVICE AND RECORDING DEVICE WITH DOWNSTREAM SEPARATING MEMBER FROM DELIVERING MEMBER

BACKGROUND

1. Technical Field

The present invention relates to a feeding device such as a paper feeding device and a recording device such as an ink jet printer having the feeding device.

2. Related Art

From the past, as disclosed in JP-A-8-91612, a recording device such as a printer includes a paper feeding device (feeding device) which automatically feeds plural sheets of paper placed in a stacked state (overlap state) to a recording portion by separating the paper sheet by sheet so that the recording is continuously performed on the paper (recording medium).

The paper feeding device disclosed in JP-A-8-91612 is equipped with a paper feeding cassette (mounting portion) allowing the plural sheets of paper to be stacked therein, a paper feeding roller delivering the top sheet of paper by a rotation motion thereof while it is in contact with the top sheet of paper from the stack of paper in a feeding direction, and a gate member for preventing the second top sheet (underlying sheet) of paper from being fed in the feeding direction along with the top sheet of paper.

In more detail, the gate member is movably supported so that is can move such that one end thereof serves as a support point and the other end thereof is in contact with the outer circumferential surface of the paper feeding roller at a predetermined pressure due to urging force of a compression spring. At the other end of the gate member, the inclined surface is provided at a position where the leading end of the paper delivered by the paper feeding roller can hit up. Therefore, if the leading end of the paper delivered by the paper feeding roller in the paper feeding direction hits up against the inclined surface, the gate member having the inclined surface pushed by the paper shakes in a direction in which it moves away from the outer surface of the paper feeding roller, while resisting against the urging force of the compression spring, and a gap is formed between the paper feeding roller and the gate member in a size such large as only one sheet of paper can pass. With such an operation, only the top sheet of paper is fed through the gap in the feeding direction. In the case in which double feeding occurs such that the sheet underlying the top sheet of the paper is fed along with the top sheet of paper due to frictional force between the top sheet and the underlying sheet of paper, the underlying sheet of paper is stopped by the inclined surface of the gate member, thus preventing the double feeding.

In such a paper feeding device, the paper feeding roller is typically configured such that the outer surface is made of a soft material, such as rubber, in order to generate frictional force for the delivery of the paper. Accordingly, as disclosed in JP-A-8-91612, if the other end of the gate member pressed up against the paper feeding roller, a problem that the outer surface of the paper feeding roller deforms arises particularly in conditions of high temperature and humidity. Here, the angle of the delivered paper to the inclined surface of the other end of the gate member is important when forming the gap between the gate member and the outer surface of the paper feeding roller, which allows only one sheet of paper to pass through, when the inclined surface of the gate member is shaken du to the being pushed by the paper.

However, there is possibility that the outer surface of the paper feeding roller comes to be dented by the pushing pressure of the gate member, so that the contact angle between the paper and the inclined surface changes. Further, since the gate member rotates around the support point when the gate member is shaken due to being pushed by the paper, the contact angle between the paper and the inclined surface may change if the gate member is vigorously shaken. If the contact angle between the paper and the inclined surface changes, it is impossible to precisely form the gap and double feeding of paper is more likely to occur.

Such a problem commonly arises in feeding devices which feed a plurality of stacked recording media while separating them one by one as well as in the above-mentioned paper feeding device of the printer.

SUMMARY

An advantage of some aspects of the invention is to provide a feeding device capable of precisely preventing the double feeding of recording media and a recording device including such a feeding device.

According to an aspect of the invention, there is provided a feeding device including: a mounting portion capable of allowing a plurality of recording media to be mounted in a stacked state thereon; a delivering member, which performs feeding operation in a state in which its contact surface is in contact with the top recording medium of the recording media mounted on the mounting portion, for performing delivery of the recording media by using the frictional force generated between the delivering member and the top recording medium as the transporting force; a separating member having an inclined surface against which a leading end of the recording medium delivered by the delivering member can hit up against, the separating member being fixed in place at a downstream side of the mounting portion in a feeding direction of the recording media; a gate member placed above the separating member and at the downstream side of the delivering member in the feeding direction of the recording media and configured such that it is movable in a direction in which it can get close to and away from the separating member; and a gate urging member which urges the gate member in a direction in which it gets close to the separating member. The top recording medium which is delivered by the delivering member and then hits up against the inclined surface of the separating member at its leading end thereof causes the gate member to move while resisting against urging force of the gate urging member, so that a gap through which only the top medium can pass is formed between the separating member and the gate member.

With such a configuration, the top recording medium, which is delivered by the delivering member and having the leading end which has hit up against the inclined surface of the separating member, is fed and forms a gap allowing only the top sheet of the recording medium to pass through between the separating member and the gate member while resisting against the urging force of the gate urging member. Accordingly, it is possible to prevent the double feeding by separating the top recording medium from the underlying recording medium. That is, according to the configuration in which the separating member having the inclined surface is fixed in place and the gate member is provided to be movable in the direction in which the gate member can get closer to and move away from the separating member, it is possible to maintain a constant contact angle between the recording medium and the inclined surface. Accordingly, it is possible to reliably prevent the double feeding of the recording media. Still further, with the configuration in which the separating member which performs separation of recording media and the gate member are provided separately from the delivering member, it is possible to choose optimum material and placement for each of them.

In the feeding device according to the invention, the gate member may be configured such that it is movable in a substantially perpendicular direction to the feeding direction of the recording media.

According to the configuration, since the gate member is configured to be movable in a substantially perpendicular direction to the feeding direction of the recording medium, it is possible to maintain the constant contact angle between the separating member and the recording medium. Accordingly, it is possible to reliably prevent the double feeding of the recording media.

In the feeding device according to the invention, the gate member urged by the gate urging member may have a guide surface having a higher rigidity than the contact surface and may be configured such that the guide surface is brought into contact with the separating member, and the top recording medium which hit up against the inclined surface of the separating member may be guided to the guide surface so as to be fed to the downstream side.

According to the configuration, since the gate member is configured such that the guide surface having a higher rigidity than the contact surface is brought into contact with the separating member, even in the case in which the guide surface is pushed by the separating member due to the urging force of the gate urging member, deforming of the guide surface is suppressed. Accordingly, it is possible to reliably prevent the double feeding of the recording media by constantly maintaining the contact angle between the separating member and the recording medium. Further, since the gate member is provided with the guide surface for guiding the recording medium to the downstream side, for example, the guide member provided in the conventional recording devices for guiding the recording medium is used as the guide surface, it is possible to suppress the increase in the space taken up and the number of parts.

In the feeding device according to the invention, the device may further include: an auxiliary separating unit placed at a downstream side of the separating member in the feeding direction of the recording media and configured such that the top recording medium passing out the gap between the separating member and the gate member can hit up against the auxiliary separating unit.

According to the configuration, since the auxiliary separating member is provided at the downstream side of the separating member in the feeding direction of the recording medium, it is possible to perform separation of the recording media on the basis of using the stiffness of the recording media due to the auxiliary separating member as a parameter as well as on the basis of using the frictional force due to the separating member as a parameter. That is, it is possible to more reliably prevent the double feeding of the recording media by simultaneously using two separation techniques.

In the feeding device according to the invention, the delivering member may be a feeding roller supported to be rotatable around a rotary shaft.

According to the configuration, since the feeding operation of the delivering member is realized by rotation of the feeding roller, it is possible to deliver the recording media in smooth and continuous motion.

In the feeding device according to the invention, the feeding roller may have an outer surface with a circumferential surface having a radius equal to the distance from the rotary shaft and a non-circumferential surface with a shorter distance from the rotary shaft than the circumferential surface, and the circumferential surface of the feeding roller may form the contact surface.

According to the configuration, since the feeding roller has a circumferential surface and a non-circumferential surface as the outer surface, it is possible to have a configuration such that the delivery of the recording medium is performed on the circumferential surface and the non-circumferential surface does not come into contact with the recording medium. Accordingly, as the feeding roller is separated from the recording medium at the non-circumferential surface after the top recording medium is delivered, it is possible to suppress back tension is unnecessarily applied to the recording medium delivered to the downstream side.

In the feeding device according to the invention, the device may further include: an auxiliary roller movable in a direction in which it can get close to and away from the feeding roller; and an auxiliary roller urging member capable of urging the auxiliary roller in a direction in which the auxiliary roller gets close to the feeding roller. The recording medium delivered by the feeding roller may be pinched by the feeding roller and the auxiliary roller and then fed along rotation motion of the feeding roller.

According to the configuration, since the feeding device is equipped with the auxiliary roller urged in the direction in which it gets closer to the feeding roller, it is possible to reliably feed the recording medium by the feeding roller and the auxiliary roller.

According to another aspect of the invention, there is provided a recording device including: a recording portion performing recording on a recording medium; and the feeding device for feeding the recording medium to the recording portion.

According to the configuration, it is possible to attain the same operative advantage of the above feeding device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an ink jet printer (hereinafter, refer to as "printer") which is a concrete example of a recording device including a feeding device according to the invention is described with reference to the accompanying drawings 1 to 5C. In the description, "longitudinal direction," "lateral direction," and "vertical direction" must be understood with reference to directions indicated by arrows of the accompanying drawings.

Figure 1:
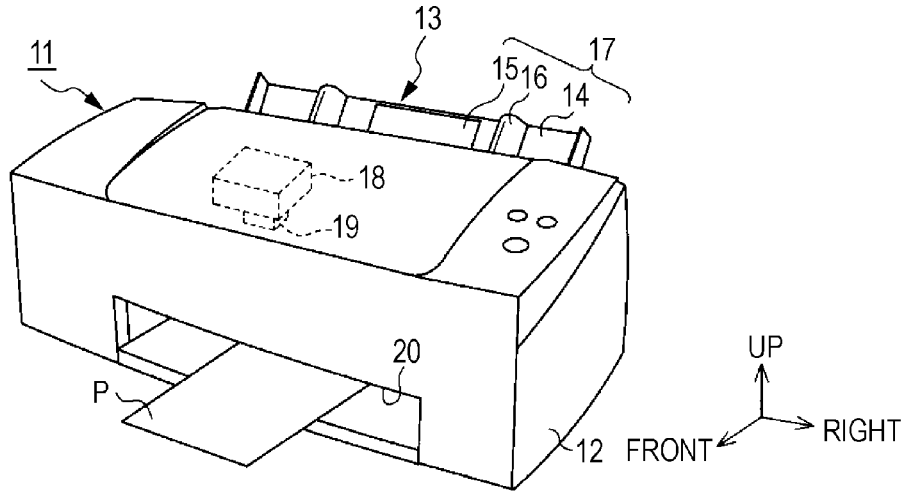
FIG. 1 is a perspective view illustrating an ink-jet printer according to one embodiment of the invention.

As shown in FIG. 1, the printer 11 according to this embodiment is provided with an automatic paper feeding device 13 which serves as a feeding device which feeds paper P as a recording medium at the rear side of a main body 12. The automatic paper feeding device 13 is equipped with a paper guide 17 which serves as a mounting portion and including a paper feeding tray 14, a hopper 15, and an edge guide 16. The automatic paper feeding device 13 is also equipped with a feeding drive mechanism (not shown) which feeds sheet by sheet paper P mounted in the paper guide 17 in a stacked state into the main body 12.

The inside of the main body 12 is provided with a carriage 18 reciprocating in a main scan direction (lateral direction in FIG. 1) and a recording head 19 which serves as a recording portion is provided under the carriage 18. Printing to the paper P is performed by alternately and repeatedly performing a recording operation of ejecting ink to the paper P from a recording head 19 while the carriage 18 moves in the main scan direction and a paper sending operation of transporting the paper P in a sub-scan direction (forward direction) by a predetermined transportation amount. The paper P to which the printing is performed is discharged through a paper discharge hole 20 which is an opening formed at a lower portion of the front side of the main body 12.

Next, description about the automatic paper feeding device 13 will be made with reference to FIG. 2.

Figure 2:
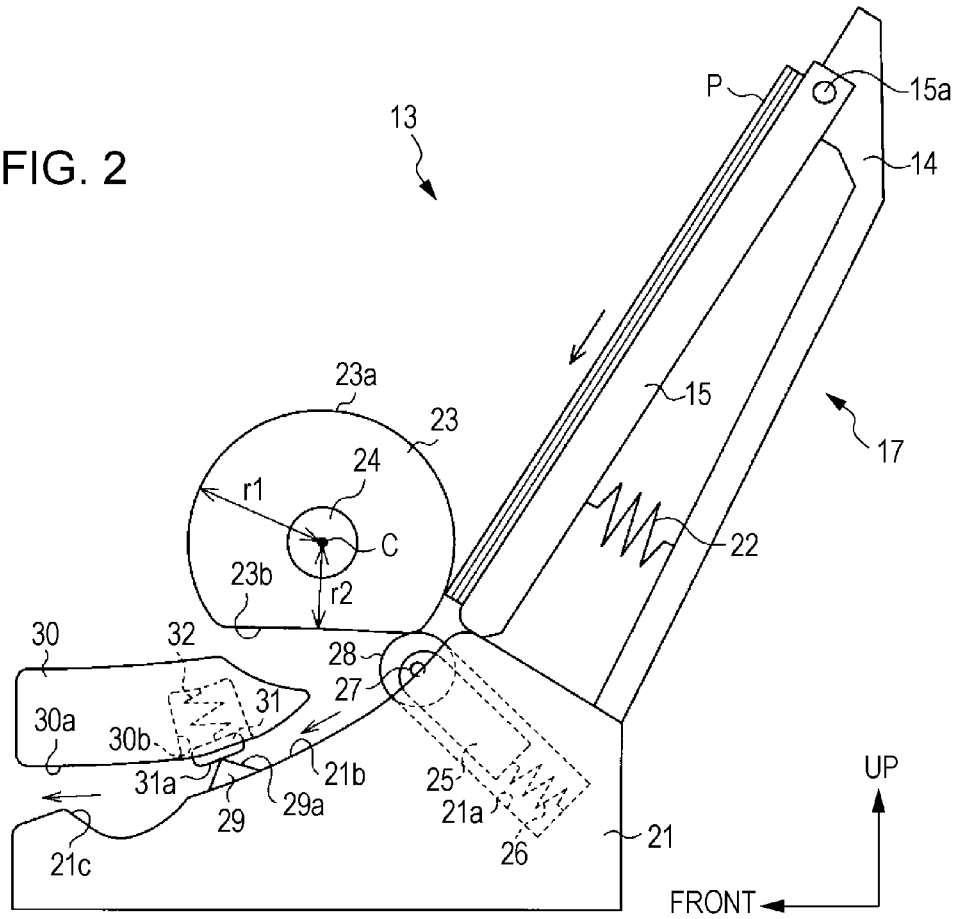
FIG. 2 is a schematic side view for explaining an automatic paper feeding device.

As shown in FIG. 2, the paper feeding tray 14 placed obliquely to the rear surface of the main body 12 is installed such that a lower end thereof is supported by the rear side of a base portion 21 and a nearly midway position of the upper surface thereof is provided with the hopper 15. Further, a lower end portion of the hopper 15 is provided with a compression spring 22 interposed between the hopper 15 and the paper feeding tray 14. The hopper 15 is configured to be able to reciprocate between a paper feeding position shown in FIG. 2 and a retreated position (see FIG. 3) while pivoting on a shaft 15*a* provided at an upper end portion thereof, in which the retreated position is a position where the lower end of the hopper 15 rests after the lower end of the hopper 15 is moved in a counterclockwise direction when the compression spring 22 is compressed.

A paper feeding roller (feeding roller) 23, which serves as a delivering member and has a substantial D shape when it is viewed from the side thereof, is placed in front of the lower portion of the hopper 15 residing at the paper feeding position and is disposed so as to be able to rotate around a rotary shaft 24. The paper feeding roller 23 has a circumferential surface 23*a* which serves as a contact surface and has a radius equal to the distance r1 from the center C of the rotary shaft 24 and a non-circumferential surface, a flat surface 23*b*, where the distance from to the center C of the rotary shaft 24, the distance r2, is smaller than the distance r1 (r2<r1) between the center of the rotary shaft 24 and the circumferential surface 23*a*.

The distances r1 and r2 from the center C of the rotary shaft 24 are set such that in the case in which the paper feeding roller 23 rotates in the state in which the hopper 15 is placed at the paper feeding position, the flat surface 23*b* is not brought into contact with the paper P but the circumferential surface 23*a* is brought into contact with the paper P and the paper P pushes and presses the circumferential surface 23*a* by receiving the urging force of the compression spring 22. Further, it is set such that the frictional force generated between the circumferential surface 23*a* and the paper P in the case in which the paper feeding roller 23 rotates in the state in which the circumferential surface 23*a* is in contact with the paper P is larger than frictional force generated between the stacked sheets of paper P. Accordingly, if the paper feeding roller 23 rotates in the state in which it is in contact with the paper P, the frictional force generated between the circumferential surface 23*a* and the paper P becomes the transporting force as the urging force of the compression spring 22 becomes perpendicular while resisting force, and this enables the paper P to be delivered.

A receiving hole 21*a*, which is open so as to face the paper feeding roller 23, is formed around the upper end of the base portion 21. A slider 25 is contained in the receiving hole 21*a* such that it can move in a direction in which it can get closer to and move away from the paper feeding roller 23. In the receiving hole 21*a*, a spring 26 is interposed between a base portion of the slider 25 and an inside bottom surface of the receiving hole 21*a*. Further, an auxiliary roller 28 is supported so as to be able to freely rotate around a rotary shaft 27 at the end portion of the slider 25 which faces the paper feeding roller 23.

The auxiliary roller 28 is in not contact with the paper feeding roller 23 in the case in which the auxiliary roller 28 faces the center portion of the flat surface 23*b* of the paper feeding roller 23, but is in contact with the circumferential surface 23*a* of the paper feeding roller 23 when the auxiliary roller 28 faces the circumferential surface 23*a* after it is moved along with the slider 25. In the case in which the auxiliary roller 28 is in contact with the circumferential surface 23*a*, the spring 26 is formed so as to urge the auxiliary roller 28 in a direction in which the auxiliary roller 28 gets close to the circumferential surface 23*a*.

If the paper feeding roller 23 rotates in the state in which the auxiliary roller 28 is in contact with the paper feeding roller 23, the auxiliary roller 28 is rotated. Further, if the paper P is delivered by the paper feeding roller 23 in the state in which the auxiliary roller 28 is rotated by the paper feeding roller 23, the paper P is pinched between the paper feeding roller 23 and the auxiliary roller 28, so that the auxiliary roller 28 moves away from the circumferential surface 23*a* by a distance corresponding to the thickness of one sheet of paper P, while resisting against the urging force of the spring 26. Therefore, the paper P is fed in the feeding direction indicated by the arrow in FIG. 2 along with the rotation of the paper feeding roller 23.

A portion of the base portion 21 which is in front of the receiving hole 21*a* is provided with a guide portion 21*b* which guides the paper P to the downstream side and extends obliquely toward a lower portion of the front side. At a position midway along the guide portion 21*b*, i.e. at the downstream side of the paper guide 17 and the auxiliary roller 28 in the feeding direction of the paper P, a separating member 29 is fixed in place. The separating member 29 is provided with an inclined surface 29*a* protruding upward higher than the guide portion 21*b* of the base portion 21 so that the paper P fed by the paper feeding roller 23 and the auxiliary roller 28 can hit up against the inclined surface 29*a* at a predetermined angle. In the base portion 21, an auxiliary separating unit 21*c* which the fed paper P can hit up against is formed in front of the separating member 29 such that it extends upward obliquely to the front side.

At the downstream side of the paper feeding roller 23 in the feeding direction of the paper P, a guide portion forming member 30 is provided above the guide portion 21*b*. At a position of an underside surface of the guide portion forming member 30 which faces the guide portion 21*b*, a guide portion 30*a* is formed for guiding the paper P to the downstream side. Further, at a position of the underside surface of the guide portion forming member 30 which faces the separating member 29, the receiving hole 30*b* is formed to extend in a direction which is substantially perpendicular to the feeding direction of the paper P.

A gate member 31 is contained in the receiving hole 30*b* so that it can freely move in a direction in which it can get closer to and move away from the separating member 29. Further, in the receiving hole 30*b*, a spring 32 which always urges the gate member 31 in a direction in which the gate member 31 gets close to the separating member 29 is interposed between the upper surface of the gate member 31 and the bottom surface of the receiving hole 30*b*. That is, since the gate member 31 is contained in the receiving hole 30*b*, it is placed at the downstream side of the paper feeding roller 23 in the feeding direction and above the separating member 29. Further, the lower surface of the gate member 31 becomes a guide surface 31*a* made of a plastic having a higher rigidity than rubber which is used to form the circumferential surface 23*a* of the paper feeding roller 23.

Next, the operation of the automatic paper feeding device 13 having the above configuration will be described with reference to FIGS. 3 to 5C.

Figure 3:
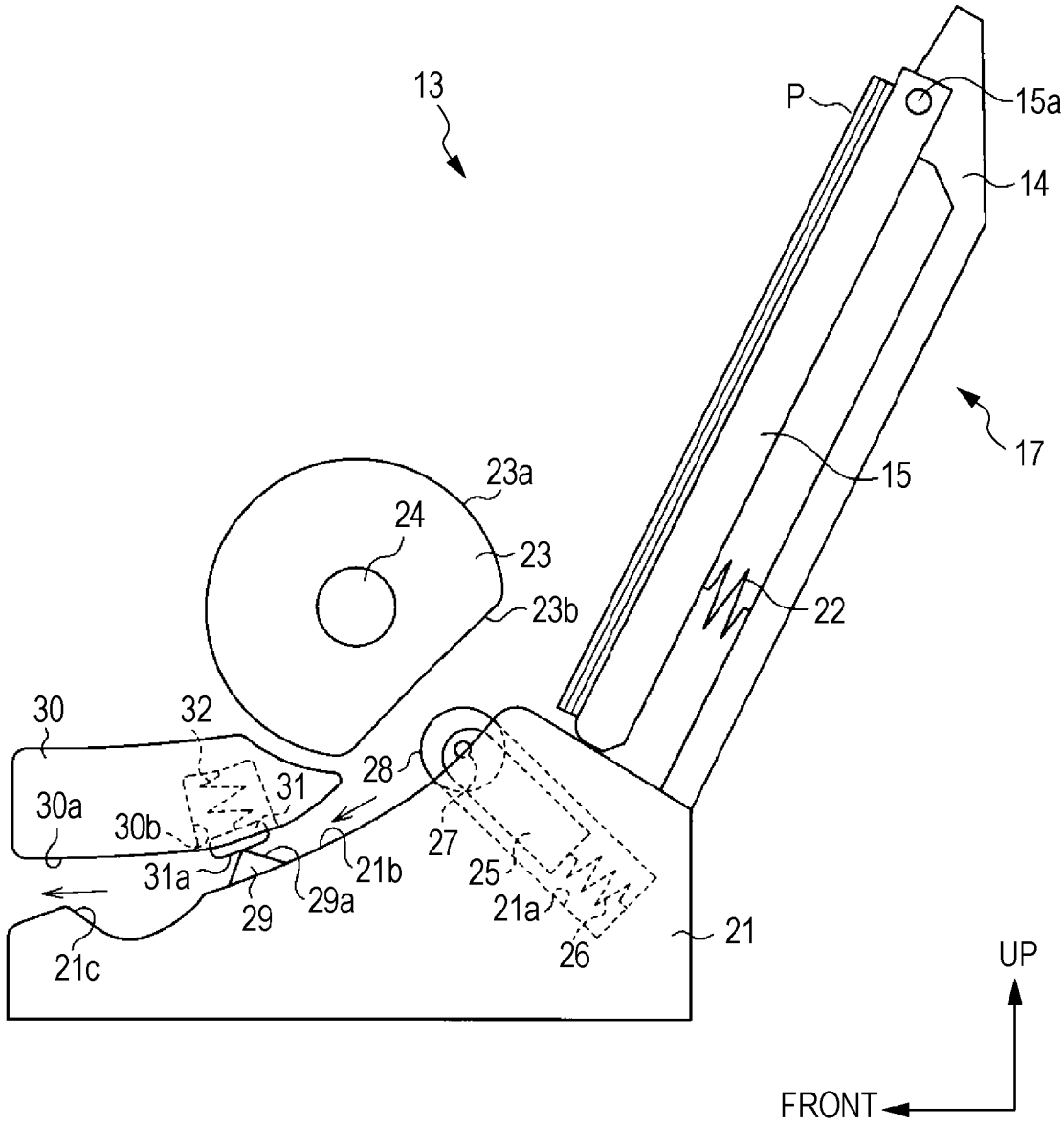
FIG. 3 is a schematic side view for explaining operation of the automatic paper feeding device, particularly showing the reset state.
Figure 4:
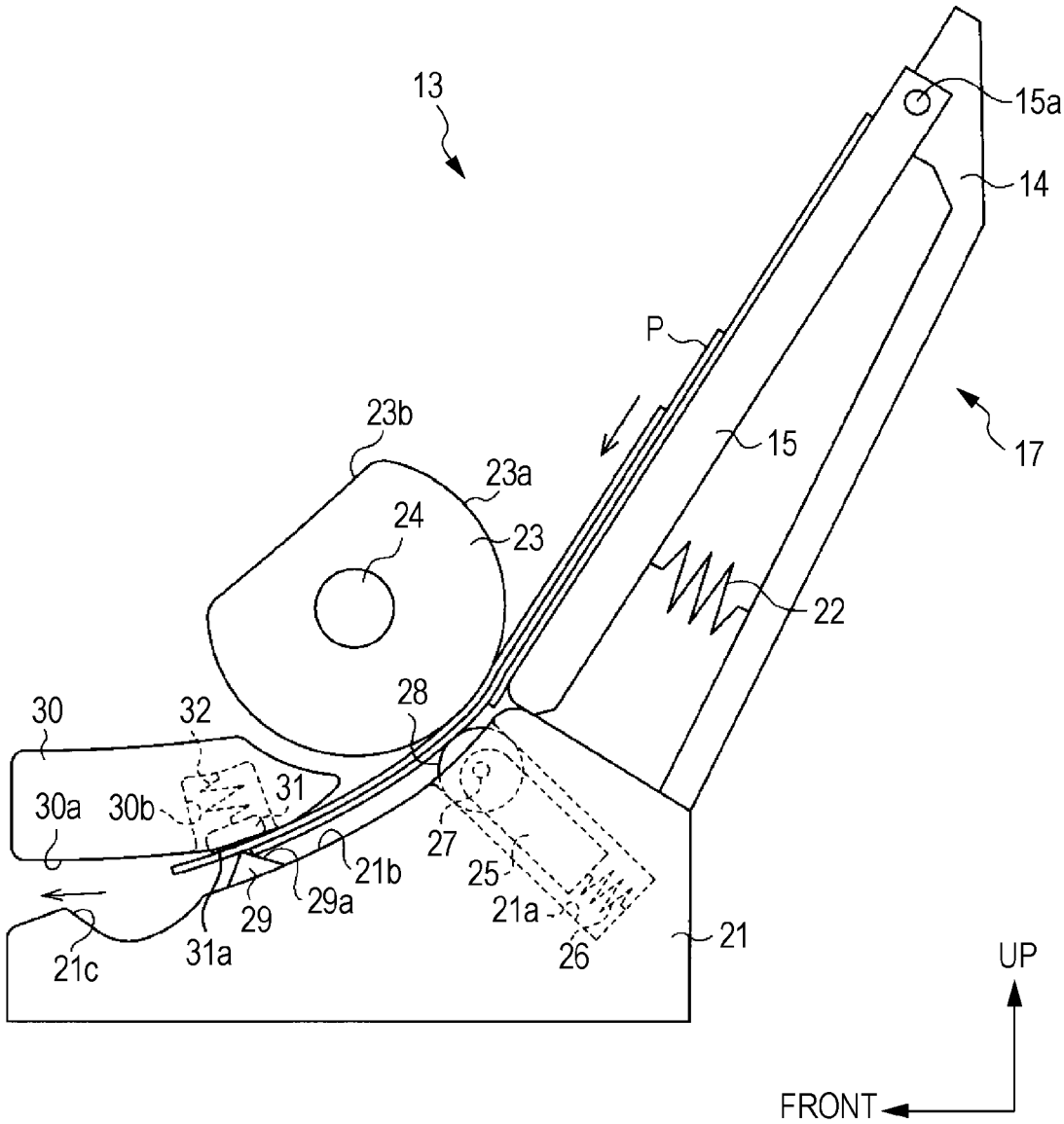
FIG. 4 is a schematic side view for explaining operation of the automatic paper feeding device, particularly showing the separated state.

At the reset position in FIG. 3, the middle portion of the flat surface 23*b* of the paper feeding roller 23 faces the auxiliary roller 28 and the hopper 15 is placed at the retreated position where the hopper 15 is separated from the paper feeding roller 23.

Further, if the paper feeding roller 23 rotates in the clockwise direction as in FIG. 3 and comes into contact with the auxiliary roller 28 as the rotary shaft 24 drives and rotates, the auxiliary roller 28 starts to be rotated along with the rotation motion of the paper feeding roller 23. After that, the hopper 15 moves to the paper feeding position from the retreated position and the top sheet of paper P comes into contact with the circumferential surface 23*a*. If the paper P is delivered as the paper feeding roller 23 further rotates from this state, the paper P is pinched between the paper feeding roller 23 and the auxiliary roller 28, and then fed to the downstream side along with the rotation motion of the paper feeding roller 23.

The top sheet of paper P fed to the paper feeding roller 23 and the auxiliary roller 28 and its leading end hits up against the inclined surface 29*a* of the separating member 29 at the leading end thereof and then causes the gate member 31 to move upward, i.e. in a direction in which the gate member 31 gets away from the separating member 29, while resisting against the urging force of the spring 32. Then, the top sheet of paper P passes through a gap formed allowing only the top sheet of paper P to pass through between the guide surface 31*a* and the separating member 29. At this time, an underlying sheet of paper P under the top sheet of paper P is delivered along with the top sheet of paper P the to the frictional force between sheets of paper P, but the underlying sheet of paper P is stopped after hitting up against the inclined surface 29*a* of the separating member 29 and is separated from the top sheet of paper P.

That is, when the top sheet of paper P hits up against the inclined surface 29*a* of the separating member 29, with transporting force F1 based on the frictional force between the top sheet of paper P and the paper feeding roller 23, a component force f1 directing in a perpendicular direction to the inclined surface 29*a* and a component force f2 directing in a parallel direction with the inclined surface 29*a* are generated. If the top sheet of paper P hits up against the inclined surface 31*a* of the gate member 31 along the inclined surface 29*a*, along with the component force f2, a component force f3 which is directed in a perpendicular direction to the guide surface 31*a* and generated based on the component force f2, causes the gate member 31 to move upward, i.e., in a direction in which the gate member 31 gets away from the separating member 29, while resisting against the urging force of the spring 32. Further, the top sheet of paper P is fed to the downstream side while being guided along the guide surface 31*a* by a component force f4 directed in a parallel direction with the guide surface 31*a* and generated based on the component force f2.

On the other hand, when the underlying sheet of paper P hits up against the inclined surface 29*a* of the separating member 29, having the transporting force P1 (P1<F1) based on the frictional force generated between itself and the top sheet of paper P, a component force p1 directed in a perpendicular direction to the inclined surface 29*a* and a component force p2 directed in a parallel direction with the inclined surface 29*a* are generated, and the component force p2 becomes the force for pushing the guide surface 31*a* of the gate member 31 via the top sheet of paper P. However, a component force p3, which is directed in a perpendicular direction to the guide surface 31*a* and generated based on the component force p2, is smaller than the urging force of the spring 32. That is, the urging force of the spring 32 and the contact angle between the paper P and the inclined surface 29*a* are set such that the urging force of the spring is smaller than the component force f3 of the top sheet of paper P, and is larger than the component force p3 of the underlying sheet of paper P.

As described above, the separation of paper P by the separating member 29, the gate member 31, and the spring is performed using the frictional force with the paper P as a parameter. However, in the case of feeding paper P, frictional force among sheets of paper P is very large, so that, on the rare occasion, the separation is not performed.

Figure 5A:
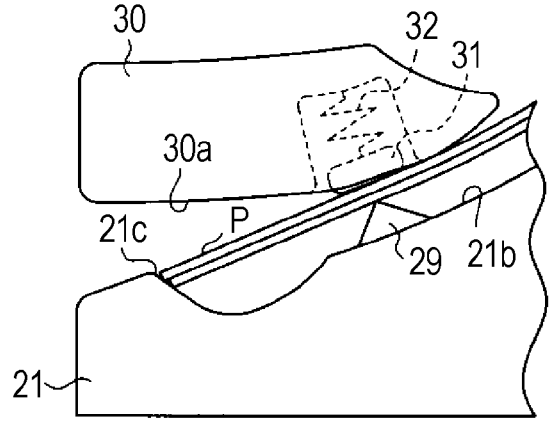
FIGS. 5A to 5C are schematic side views for explaining separation by an auxiliary separating unit.

In the case in which the top sheet of paper P passes through the gap between the separating member 29 and the gate member 31 in a state in which the separation has not been performed and it overlaps with the underlying sheet of paper P, as shown in FIG. 5A, the leading ends of sheets of paper P hit up against the auxiliary separating unit 21*c*. At this time, the sheets of paper P whose leading ends are pinched between the separating member 29 and the gate member have free leading ends but bending thereof is suppressed because the strong stiffness of the sheets of paper P acts as a force for suppressing the bending of the paper, so that the sheets of paper hit up against the auxiliary separating unit 21*c* at a predetermined angle while bending thereof is suppressed.

Figure 5B:
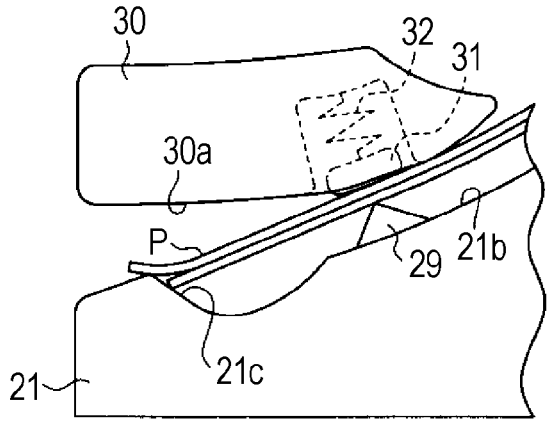

If the paper feeding roller 23 rotates in such a state, the force for suppressing the bending of the top sheet of paper P affects the top sheet of paper P hit up against the auxiliary separating unit 21*c* as a stopping force while resisting against the transporting force which directs in the feeding direction. Further, as the transporting force is greater than the stopping force and the leading end of the top sheet of paper P is bent upward along the auxiliary separating unit 21*c* as shown in FIG. 5B, the top sheet of paper P rides over the auxiliary separating unit 21*c*.

Figure 5C:
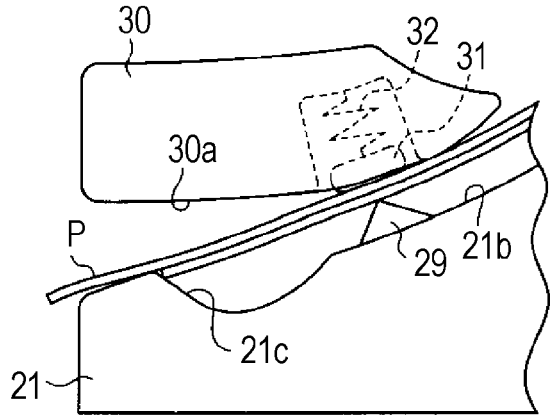

On the other hand, when the underlying sheet of paper P hits up against the auxiliary separating unit 21*c*, the suppressing force for suppressing the bending of the top sheet of paper P is added to the suppressing force for suppressing the bending of the underlying sheet of paper P and this becomes a load and acts as a stopping force, with the suppressing force being greater than the transporting force. For this reason, the underlying sheet of paper P can not ride over the auxiliary separating unit 21*c* and therefore it is separated from the top sheet of paper P. As shown in FIG. 5C, only the top sheet of paper P which is separated is fed to the downstream side of the auxiliary separating unit 21*c*.

In this manner, the auxiliary separating unit 21*c* performs separation using the stiffness of paper P as a parameter, the contact angle between the paper P and the auxiliary separating unit 21*c*, the length of the free end portion of the paper P, and the height of the bank which the paper P rides over are set. Accordingly, in the case in which the frictional force generated between sheets of paper P is high, separation between sheets of paper P can be performed.

According to the above-described embodiment, the following advantages can be attained.

(1) The top sheet of paper P, which is delivered by the paper feeding roller 23 and the leading end of which hit up against the inclined surface 29*a* of the separating member 29, is fed while forming a gap through which only the top sheet of paper P can pass between the separating member 29 and the gate member 31 while resisting the urging force of the spring 32. Accordingly, it is possible to prevent double feeding by performing separation between the top sheet of paper P and the underlying sheet of paper P.

(2) The separating member 29 having the inclined surface 29*a* is fixed in place and the feeding device is provided with the gate member 31 configured so as to be able to move in a direction in which the gate member 31 can get closer to and move away from the separating member 29. Accordingly, it is possible to maintain a constant contact angle between the paper P and the inclined surface 29*a*. Accordingly, it is possible to reliably prevent the double feeding of the paper P. Moreover, when transporting the paper P so as to form a gap between the separating member 29 and the gate member, since the gate member 31 moves upward such that it gets away from the separating member 29, the underlying sheet of paper P pushes and presses the gate member 31 via the top sheet of paper P. That is, since it is controlled such that the entering of the underlying sheet of paper P into the gap between the gate member 31 and the separating member 29 is prevented, the separation is more reliably performed.

(3) The separating member 29 for separating paper P and the gate member 31 is separately provided from the paper feeding roller 23. Accordingly, it is possible to select the optimum materials and placements for them.

(4) The gate member 31 is configured to be able to move in an almost perpendicular direction to the feeding direction of the paper P. Accordingly, it is possible to maintain a constant contact angle between the separating member 29 and the paper P. Accordingly, it is possible to reliably prevent the double feeding of the paper P.

(5) The gate member 31 is configured such that the guide surface 31*a*, which has a higher rigidity than the circumferential surface 23*a*, is brought into contact with the separating member 29. Accordingly, in the case in which the gate member 31 is pushed and pressed against the separating member 29 by the urging force of the spring 32, it is possible to suppress the deformation of the guide surface 31*a*. Accordingly, it is possible to maintain a constant contact angle between the separating member 29 and the paper P, and therefore it is possible to reliably prevent the double feeding of the paper P.

(6) The gate member 31 is provided with the guide surface 31*a* for introduce the paper P to the downstream side and is contained in the receiving hole 30*b* of the guide portion forming member 30. Accordingly, there is no need to set aside a space for the gate member 31.

(7) The auxiliary separating unit 21*c* is provided at the downstream side of the separating member 29 in the feeding direction of the paper P. Accordingly, it is possible to separate the paper P by using stiffness as a parameter as well as by using frictional force as a parameter. That is, it is more reliably prevent the double feeding of the paper P by using two separation techniques based on different kinds of technical principles.

(8) Feeding operation is realized by the rotation of the paper feeding roller 23. Accordingly, it is possible to perform the delivery of the paper P smoothly and continuously.

(9) After the top sheet of paper P is delivered, the paper feeding roller 23 is separated from the paper P on the flat surface 23*b*. Accordingly, it is possible to inhibit back tension unnecessarily applied to the paper P delivered to the downstream side.

(10) The feeding device is equipped with the auxiliary roller 28 which urges it in the direction in which it gets closer to the paper feeding roller 23. Accordingly, it is possible to reliably feed the paper P by the paper feeding roller 23 and the auxiliary roller 28.

The above embodiment may be altered to the following embodiments.

The paper feeding operation may be realized by the movement of a transporting belt instead of the rotation of the paper feeding roller 23.

The paper feeding roller 23 may be a circular roller having a circular shape when it is viewed from the side thereof.

In the above-described embodiment, the ink jet printer and the ink cartridge have been used. However, a liquid ejecting apparatus discharging or ejecting another liquid other than ink and a liquid storing unit storing the liquid may be used. The invention is useful for various liquid ejecting apparatuses including a liquid ejecting head for ejecting minute liquid droplets. The liquid droplet refers to a liquid ejected from the liquid ejecting apparatus and includes a liquid having a particle shape, a liquid having a droplet shape, and a liquid having a thread trailing shape. The liquid is a material which can be ejected by the liquid ejecting apparatus. For example, the liquid is a matter in a liquefied state and includes a liquid of a fluid state such as a liquid-like material having high or low viscosity, sol, gel water, other inorganic solvents, an organic solvent, liquid solution, liquid-like resin, and liquid-like metal (metallic melt), a liquid in one state of a matter, and a liquid in which particles of a functional material formed of a solid matter such as colorant or metal particle is dissolved, dispersed, or mixed. Representative examples of a liquid are ink or liquid crystal, as described in the embodiment. Here, the ink includes a liquid composition such as general water-based ink, general oil-based ink, gel ink, and hot-melt ink. Specific examples of the liquid ejecting apparatus include a liquid crystal display, an EL (electro-luminescence) display, a plane emission display, a liquid ejecting apparatus ejecting a liquid containing a material such as an electrode material or a color material used to manufacture a color filter is dispersed or dissolved, a liquid ejecting apparatus ejecting bio organism used to manufacture a bio chip, a liquid ejecting apparatus ejecting a liquid as a sample used by a precise pipette, a printing apparatus, and a micro dispenser. In addition, examples of the liquid ejecting apparatus include a liquid ejecting apparatus ejecting a lubricant to a precision instrument such as a clock or a camera by a pin point, a liquid ejecting apparatus ejecting a transparent resin liquid such as ultraviolet cured resin on a board to form a minute hemispheric lens (an optical lens) used in an optical communication element or the like, and a liquid ejecting apparatus ejecting an acid or alkali etching liquid to etch a board or the like. In addition, the invention is applicable to one liquid ejecting thereof and the liquid storing unit.

What is claimed is:

1. A feeding device comprising:

a mounting portion capable of having a plurality of recording media mounted in a stacked state thereon;

a delivering member which performs feeding operation in a state in which a contact surface of the delivering member is in contact with a top recording medium of the recording media mounted on the mounting portion to perform delivery of the recording media by using a frictional force generated between the delivering member and the top recording medium as a transporting force; wherein the delivering member is a feeding roller supported so as to be able to rotate around a rotary shaft;

a separating member having an inclined surface against which a leading end of the recording medium delivered by the delivering member hits up against, the separating member being fixed in place at a downstream side of the mounting portion in a feeding direction of the recording media;

a gate member placed above the separating member and at a downstream side of the delivering member in the feeding direction of the recording media such that the gate member is able to move in a direction in which the gate member gets closer to and moves away from the separating member;

a gate urging member which urges the gate member in a direction in which the gate member gets closer to the separating member;

an auxiliary roller able to move in a direction in which the auxiliary roller gets closer to and moves away from the feeding roller; and an auxiliary roller urging member capable of urging the auxiliary roller in a direction in which the auxiliary roller gets closer to the feeding roller, wherein the recording medium delivered by the feeding roller is pinched by the feeding roller and the auxiliary roller and then fed along by the rotation motion of the feeding roller.

2. The feeding device according to claim 1, wherein the gate member is configured such that the gate member is able to move in a substantially perpendicular direction to the feeding direction of the recording media.

3. The feeding device according to claim 1, wherein the gate member urged by the gate urging member has a guide surface, which as a higher rigidity than the contact surface of the delivering member and is configured such that the guide surface is brought into contact with the separating member, and wherein the top recording medium which hits up against the inclined surface of the separating member is guided to the guide surface so as to be fed to the downstream side.

4. The feeding device according to claim 1, further comprising:

an auxiliary separating unit placed at a downstream side of the separating member in the feeding direction of the recording media and configured such that the top recording medium, which passes out a gap between the separating member and the gate member, hits up against the auxiliary separating unit.

5. The feeding device according to claim 1, wherein the feeding roller has an outer surface with of a circumferential surface having a radius equal to a distance from the rotary shaft and a non-circumferential surface with a shorter distance from the rotary shaft than the circumferential surface, and the circumferential surface of the feeding roller forms the contact surface.

6. A recording device comprising:

a recording portion performing recording on a recording medium; and the feeding device according to claim 1 for feeding the recording medium to the recording portion.

* * * * *